US011994306B2

(12) United States Patent
Iwasaki et al.

(10) Patent No.: US 11,994,306 B2
(45) Date of Patent: May 28, 2024

(54) OUTDOOR UNIT AND AIR-CONDITIONING APPARATUS

(71) Applicant: Mitsubishi Electric Corporation, Tokyo (JP)

(72) Inventors: Kazuhisa Iwasaki, Tokyo (JP); Takeshi Hatomura, Tokyo (JP); Yoji Onaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 330 days.

(21) Appl. No.: 17/608,958

(22) PCT Filed: Jul. 10, 2019

(86) PCT No.: PCT/JP2019/027278
§ 371 (c)(1),
(2) Date: Nov. 4, 2021

(87) PCT Pub. No.: WO2021/005737
PCT Pub. Date: Jan. 14, 2021

(65) Prior Publication Data
US 2022/0214055 A1 Jul. 7, 2022

(51) Int. Cl.
*F24F 1/30* (2011.01)

(52) U.S. Cl.
CPC ..... *F24F 1/30* (2013.01)

(58) Field of Classification Search
CPC ..... F25B 2313/02742; F25B 2313/02743
See application file for complete search history.

(56) References Cited

U.S. PATENT DOCUMENTS

2015/0292756 A1* 10/2015 Takenaka ..... F24F 5/001 62/160
2016/0209084 A1* 7/2016 Kawano ..... F25B 39/00
(Continued)

FOREIGN PATENT DOCUMENTS

JP 2757584 B2 5/1998
JP 2018013286 A * 1/2018 ..... F25B 49/02
(Continued)

OTHER PUBLICATIONS

International Search Report of the International Searching Authority mailed Aug. 27, 2019 for the corresponding International application No. PCT/JP2019/027278 (and English translation).

*Primary Examiner* — Nelson J Nieves
(74) *Attorney, Agent, or Firm* — Posz Law Group, PLC

(57) ABSTRACT

An outdoor unit according to the present disclosure includes: a compressor that sucks refrigerant, compresses the sucked refrigerant, and discharges the compressed refrigerant; a first refrigerant flow switching device that switches a flow passage for the refrigerant between a flow passage for a cooling operation and a flow passage for a heating operation; a heat-source-side heat exchanger that causes heat exchange to be performed between the refrigerant and external fluid; a heat-source-side backflow prevention device and a connection pipe that are included in a flow passage for the refrigerant in which an outlet from which the refrigerant flows to an outside region and an inlet into which the refrigerant flows from the outside region are unchanged regardless of which of the cooling operation and the heating operation is performed; and a flow passage pipe through which part of the refrigerant having flowed from the inlet passes in the cooling operation.

4 Claims, 6 Drawing Sheets

(56) References Cited

U.S. PATENT DOCUMENTS

| | | | | |
|---|---|---|---|---|
| 2019/0137148 | A1* | 5/2019 | Matsuda | F25B 6/02 |
| 2019/0331375 | A1* | 10/2019 | Tanaka | F25B 47/02 |
| 2020/0166258 | A1* | 5/2020 | Wang | F25B 31/004 |
| 2021/0356185 | A1* | 11/2021 | Yang | F25B 49/02 |

FOREIGN PATENT DOCUMENTS

| | | | | |
|---|---|---|---|---|
| WO | 2014/103407 | A1 | 7/2014 | |
| WO | WO-2017216861 | A1 * | 12/2017 | F24F 11/84 |

* cited by examiner

OUTDOOR UNIT AND AIR-CONDITIONING APPARATUS

CROSS REFERENCE TO RELATED APPLICATION

This application is a U.S. national stage application of International Application No. PCT/JP2019/027278 filed on Jul. 10, 2019, the contents of which are incorporated herein by reference.

TECHNICAL FIELD

The present disclosure relates to an outdoor unit and an air-conditioning apparatus, and particularly to an outdoor unit and an air-conditioning apparatus in which an inlet and an outlet are unchanged regardless of on which of operations is performed.

BACKGROUND

An air-conditioning apparatus includes, for example, a refrigerant circuit in which an outdoor unit that is a heat source unit and installed outside a building and an indoor unit installed in the building are connected by pipes. In the refrigerant circuit, refrigerant is circulated to heat or cool air by transferring or receiving heat to or from the air, thereby heating or cooling an air-conditioned space that is a load.

An existing air-conditioning apparatus includes an outdoor unit and a relay unit that are connected by two pipes, and is capable of performing a cooling and heating mixed operation (for example, see Patent Literature 1). In this air-conditioning apparatus, check valves that are backflow prevention devices are provided at a plurality of refrigerant pipes in the outdoor unit. Thus, in both a cooling operation and a heating operation, a pipe through which refrigerant flows out of the outdoor unit is used as a dedicated outflow pipe and a pipe through which the refrigerant flows into the outdoor unit is used as a dedicated inflow pipe; that is, the outflow pipe and the inflow pipe are not interchanged. Thus, the air-conditioning apparatus can achieve a stable operation.

PATENT LITERATURE

Patent Literature 1: Japanese Patent No. 2757584

In an air-conditioning apparatus disclosed in Patent Literature 1, however, low-temperature and low-pressure liquid refrigerant and gas refrigerant both pass through an inflow pipe. Thus, in particular, in the cooling operation, when the gas refrigerant passes through a backflow prevention device, a pressure loss increases, thus reducing a cooling performance.

SUMMARY

The present disclosure is applied to solve the above problem, and relates to an outdoor unit and an air-conditioning apparatus that can achieve a stable operation without reducing the performance.

An outdoor unit according to an embodiment of the present disclosure includes: a compressor that sucks refrigerant, compresses the sucked refrigerant, and discharges the compressed refrigerant; a first refrigerant flow switching device that switches a flow passage for the refrigerant between a flow passage for a cooling operation and a flow passage for a heating operation; a heat-source-side heat exchanger that causes heat exchange to be performed between the refrigerant and external fluid; a heat-source-side backflow prevention device and a connection pipe that are included in a flow passage for the refrigerant in which an outlet from which the refrigerant flows out to an outside region and an inlet into which the refrigerant flows from the outside region are unchanged regardless of which of the cooling operation and the heating operation is performed; and a flow passage pipe through which part of the refrigerant having flowed from the inlet passes in the cooling operation.

Furthermore, an air-conditioning apparatus according to another embodiment of the present disclosure includes the above outdoor unit and an indoor unit that receives heat transferred from the outdoor unit and conditions air in an air-conditioned space.

In the outdoor unit according to the embodiment of the present disclosure, because of provision of the flow passage pipe that allows, in the cooling operation, part of refrigerant having flowed from the inlet to pass, the amount of gas refrigerant or two-phase gas-liquid refrigerant that passes through the heat-source-side backflow prevention device can be reduced, and a pressure loss of the refrigerant can be reduced. Furthermore, since a larger number of flow passages through which the refrigerant passes are provided, the pressure loss of the refrigerant can be reduced.

DETAILED DESCRIPTION

Embodiments of the present disclosure will be described with reference to the drawings. In each of figures that will be referred to, components which are the same as or equivalent to those in a previous figure or figures are denoted by the same reference signs. The same is true of the entire text of the "Description of Embodiments" section. Also, in the entire text, the configurations of components are described by way of example; that is, the configuration of the components are not limited to those described in the specification. In particular, in the case where components are combined, it is not limited to the case where components according to the same embodiment are combined. A component in an embodiment can be applied to another embodiment as appropriate. Also, the levels of temperature, pressure, etc., are not determined in relation to absolute values, that is, they are relatively determined in accordance with the state and operation of a system or an apparatus, for example.

In addition, with respect to a plurality of devices that are of the same type and distinguished from each other by suffixes, in the case where they do not particularly need to be identified or distinguished from each other, the suffixes may be omitted. Additionally, in some cases, the relationship between sizes of components in the figures may differ from the relationship between the actual sizes of the components.

Embodiment 1

<Configuration of Air-Conditioning Apparatus 100>

Figure 1:
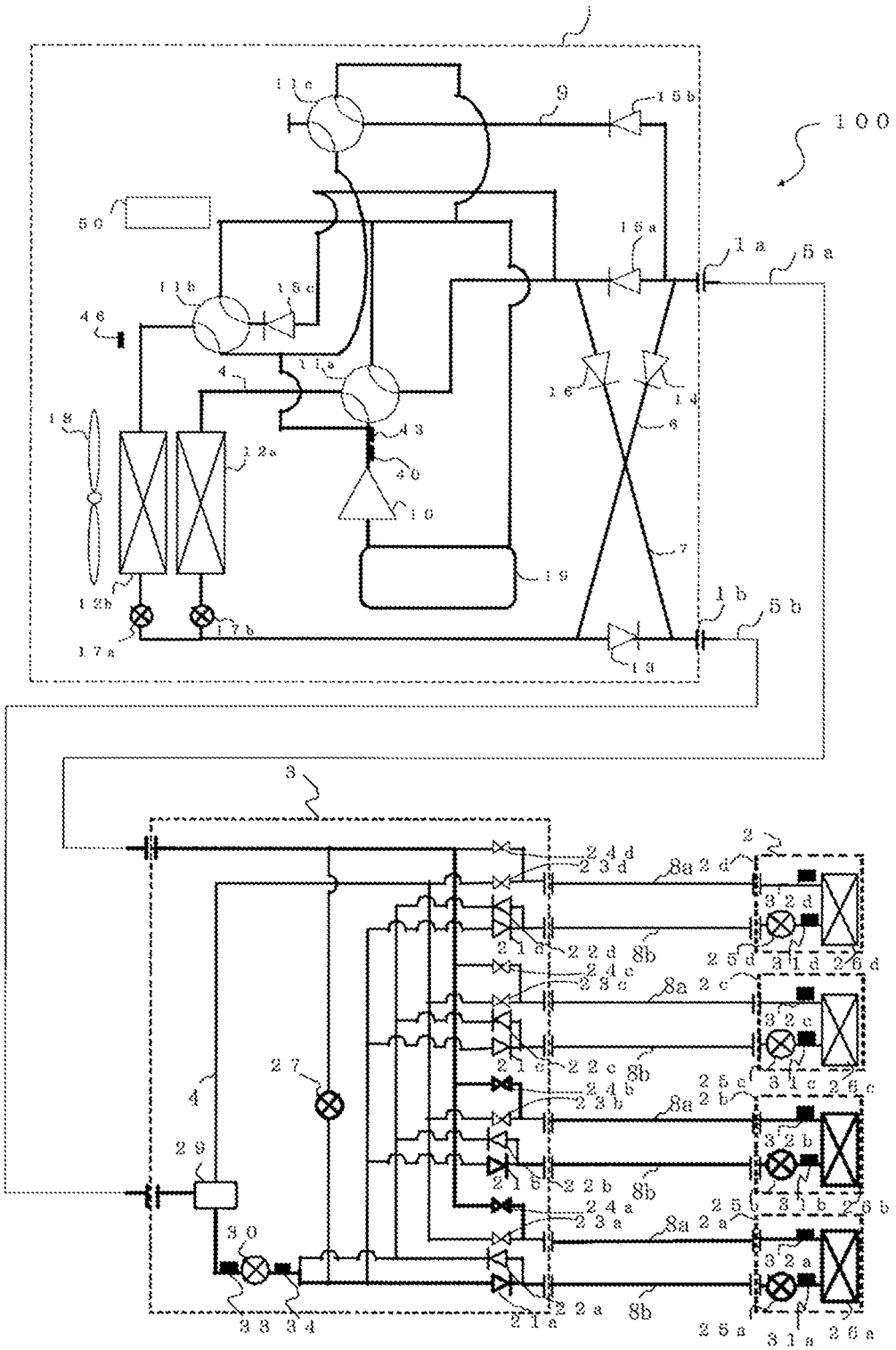
FIG. 1 illustrates a configuration of an air-conditioning apparatus 100 according to Embodiment 1.

FIG. 1 illustrates a configuration of an air-conditioning apparatus 100 according to Embodiment 1. As illustrated in FIG. 1, the air-conditioning apparatus 100 includes a single outdoor unit 1 that serves as a heat source unit, four indoor units 2 that are an indoor unit 2*a*, an indoor unit 2*b*, an indoor unit 2*c*, and an indoor unit 2*d*, and a relay unit 3 provided between the outdoor unit 1 and the indoor units 2*a* to 2*d*. In the air-conditioning apparatus 100 according to Embodiment 1, the outdoor unit 1, the indoor units 2, and the relay unit 3 are connected by pipes to form a refrigerant circuit. It should be noted that although FIG. 1 illustrates four indoor units 2 that are the indoor units 2*a* to 2*d*, the number of indoor units 2 connected together may be two, three, or five or more.

The outdoor unit 1 and the relay unit 3 are connected by an outflow pipe 5*b* and an inflow pipe 5*a* that are two pipes through which refrigerant passes. Furthermore, the relay unit 3 and each of the indoor units 2*a* to 2*d* are connected by branch pipes 8*a* and 8*b* through which refrigerant flows. Cooling energy or heating energy generated in the outdoor unit 1 is supplied to the indoor units 2*a* to 2*d* via the relay unit 3. Each of the indoor units 2*a* to 2*d* can select and perform a cooling operation or a heating operation.

The outflow pipe 5*b* and the inflow pipe 5*a* are pipes that connect the outdoor unit 1 and the relay unit 3. In particular, in the outdoor unit 1, the inflow pipe 5*a* is connected to an inlet 1*a* of the outdoor unit 1, and the outflow pipe 5*b* is connected to an outlet 1*b* of the outdoor unit 1. The outflow pipe 5*b* is a high-pressure side pipe through which high-pressure refrigerant flows out from the outlet 1*b* of the outdoor unit 1. The inflow pipe 5*a* is a low-pressure side pipe into which low-pressure refrigerant whose pressure is lower than the pressure of refrigerant in the outflow pipe 5*b* flows via the inlet 1*a* of the outdoor unit 1. The relay unit 3 and each of the indoor units 2*a* to 2*d* are connected by two branch pipes 8*a* and 8*b*. Thus, the outdoor unit 1 and the relay unit 3 are connected by using two pipes, and the relay unit 3 and each of the indoor units 2*a* to 2*d* are also connected by two pipes, whereby the air-conditioning apparatus 100 can be easily installed.

<Configuration of Outdoor Unit 1>

The outdoor unit 1 is a heat source unit that generates heat to be supplied to a load. The outdoor unit 1 includes a compressor 10, refrigerant flow switching devices 11, heat-source-side heat exchangers 12, heat-source-side expansion devices 17, a heat-source-side fan 18, and an accumulator 19 that are all housed in a housing of the outdoor unit 1. The compressor 10, the refrigerant flow switching devices 11, the heat-source-side heat exchangers 12, the heat-source-side expansion devices 17, and the accumulator 19 are connected by refrigerant pipes 4. The compressor 10 sucks refrigerant, compresses the refrigerant to change into high-temperature and high-pressure refrigerant, and then discharges the high-temperature and high-pressure refrigerant. The compressor 10 may be, for example, an inverter compressor whose capacity can be controlled.

As described later, the refrigerant flow switching devices 11 each switch the flow of refrigerant in the refrigerant circuit between the flow of refrigerant in the refrigerant circuit in the heating operation, for example, in a heating only operation mode or a heating main operation mode and the flow of refrigerant in the refrigerant circuit in the cooling operation, for example, in a cooling only operation mode or a cooling main operation mode. During the heating operation, gas refrigerant flows out of the outdoor unit 1, and liquid refrigerant or two-phase gas-liquid refrigerant flows into the outdoor unit 1. Furthermore, during the cooling operation, liquid refrigerant or two-phase gas-liquid refrigerant flows out of the outdoor unit 1, and gas refrigerant or two-phase gas-liquid refrigerant flows into the outdoor unit 1. It should be noted that the outdoor unit 1 according to Embodiment 1 includes three refrigerant flow switching devices 11 that are a first refrigerant flow switching device 11*a*, a first refrigerant flow switching device 11*b*, and a second refrigerant flow switching device 11*c*. The refrigerant flow switching devices 11 according to Embodiment 1 are four-way valves. The refrigerant flow switching devices 11 will be described in detail later.

The heat-source-side heat exchangers 12 causes heat exchange to be performed between refrigerant and outside air, that is, outdoor air that is supplied from the heat-source-side fan 18 which will be described later. The heat-source-side heat exchangers 12 each operate as an evaporator in the heating operation to cause the refrigerant to absorb heat. Furthermore, the heat-source-side heat exchangers 12 each operate as a condenser or a radiator in the cooling operation to cause refrigerant to transfer heat. Although the heat-source-side heat exchangers 12 causes heat exchange to be performed between the refrigerant and outside air, the heat-source-side heat exchangers 12 may cause heat exchange to be performed between the refrigerant and other external fluid. In the air-conditioning apparatus 100 according to Embodiment 1, the outdoor unit 1 includes two heat-source-side heat exchangers 12*a* and 12*b* that are connected in parallel by pipes. The heat-source-side expansion devices 17 adjust the flow rate and pressure of refrigerant that passes through the heat-source-side heat exchangers 12. In the air-conditioning apparatus 100 according to Embodiment 1, the outdoor unit 1 includes heat-source-side expansion devices 17*b* and 17*a* that are provided in association with the two heat-source-side heat exchangers 12*a* and 12*b*, respectively. The heat-source-side fan 18 makes a flow of air along which outside air is supplied to the heat-source-side heat exchangers 12.

The accumulator 19 is provided on a suction side of the compressor 10. The accumulator 19 stores surplus refrigerant the amount of which corresponds to the difference between the amount of refrigerant that flows during the heating operation and the amount of refrigerant that flows during the cooling operation, or the amount of which corresponds to the difference between the amount of refrigerant that flows after a transient change of the operation and the amount of refrigerant that flows before the transient change of the operation.

Furthermore, the outdoor unit 1 according to Embodiment 1 includes a first connection pipe 6, a second connection pipe 7, a heat-source-side backflow prevention device 13, a heat-source-side backflow prevention device 14, heat-source-side backflow prevention devices 15, and a heat-source-side backflow prevention device 16. Additionally, the outdoor unit 1 according to Embodiment 1 includes a flow passage pipe 9 that allows part of refrigerant that has flowed therein from the inflow pipe 5*a* to flow to the accumulator 19 provided on the suction side of the compressor 10. The outdoor unit 1 includes the first connection pipe 6, the second connection pipe 7, and the heat-source-side backflow prevention devices 13 to 16, thereby enabling refrigerant to flow out from the outdoor unit 1 to the outflow pipe 5*b* and to flow from the inflow pipe 5*a* into the outdoor unit 1, regardless of which of operations, such as heating and cooling operations, is performed. Therefore, the outlet 1*b* and the inlet 1*a* in the outdoor unit 1 are not changed depending on which of operations is performed; that is, the outlet 1*b* and the inlet 1*a* in the outdoor unit 1 are used as a dedicated outlet and a dedicated inlet, respectively. Although the heat-source-side backflow prevention devices 13 to 16 will be described as check valves, the heat-source-side backflow prevention devices 13 to 16 may be on-off valves or other valves.

In the cooling only operation mode and the cooling main operation mode, the heat-source-side backflow prevention device 13 allows refrigerant from a heat-source-side heat exchanger 12 to flow to the outflow pipe 5*b*. Furthermore, in the heating only operation mode and the heating main operation mode, the heat-source-side backflow prevention device 13 prevents the backflow of refrigerant in the second connection pipe 7, that is, prevents the refrigerant in the second connection pipe 7 from flowing toward the heat-source-side heat exchanger 12. In the heating only operation mode and the heating main operation mode, the heat-source-side backflow prevention device 14 allows refrigerant in the inflow pipe 5*a* to flow toward the heat-source-side heat exchanger 12. Furthermore, in the cooling only operation mode and the cooling main operation mode, the heat-source-side backflow prevention device 14 prevents the backflow of refrigerant in the first connection pipe 6, that is, prevents the refrigerant in the first connection pipe 6 from flowing toward to the inflow pipe 5*a*. In the heating only operation mode and the heating main operation mode, the heat-source-side backflow prevention device 16 allows refrigerant in a flow passage on a discharge side of the compressor 10 to flow toward the outflow pipe 5*b*. Furthermore, in the cooling only operation mode and the cooling main operation mode, the heat-source-side backflow prevention device 16 prevents the backflow of refrigerant in the second connection pipe 7, that is, prevents the refrigerant in the second connection pipe 7 from flowing toward the accumulator 19.

In the cooling only operation mode and the cooling main operation mode, the heat-source-side backflow prevention devices 15 according to Embodiment 1 allows refrigerant in the inflow pipe 5*a* to flow toward the accumulator 19 provided on the suction side of the compressor 10 via the refrigerant flow switching devices 11. The air-conditioning apparatus 100 according to Embodiment 1 includes, as the heat-source-side backflow prevention devices 15, a heat-source-side backflow prevention device 15*a*, a heat-source-side backflow prevention device 15*b*, and a heat-source-side backflow prevention device 15*c*. In particular, it should be noted that the heat-source-side backflow prevention device 15*b* is a flow passage pipe backflow prevention device. In the air-conditioning apparatus 100 according to Embodiment 1, flow passages are provided through which refrigerant having flowed from the inflow pipe 5*a* into the outdoor unit 1 passes through the heat-source-side backflow prevention device 15*a* and the heat-source-side backflow prevention device 15*b* and flows to the accumulator 19 in the cooling only operation mode and the cooling main operation mode. Furthermore, the refrigerant that has passed through the heat-source-side backflow prevention device 15*a* further branches into refrigerant streams. In the air-conditioning apparatus 100 according to Embodiment 1, a flow passage is provided through which one of the refrigerant streams passes through the heat-source-side backflow prevention device 15*c* and flows to the accumulator 19.

As described above, the outdoor unit 1 includes the refrigerant flow switching devices 11 each of which switches a refrigerant flow passage therein between a plurality of refrigerant flow passages, depending on which of the operations is performed. The first refrigerant flow switching device 11*a* switches, in the cooling operation, a refrigerant flow passage therein to a refrigerant flow passage through which refrigerant discharged from the compressor 10 flows to the heat-source-side heat exchanger 12*a* and refrigerant having flowed from the inflow pipe 5*a* flows to the accumulator 19. Furthermore, in the heating operation, the first refrigerant flow switching device 11*a* switches the flow passage for the refrigerant to a flow passage through which the refrigerant discharged from the compressor 10 flows to the outflow pipe 5*b* and the refrigerant having flowed from the inflow pipe 5*a* passes through the heat-source-side heat exchanger 12*a* and flows to the accumulator 19. The first refrigerant flow switching device 11*b* switches, in the cooling operation, a refrigerant flow passage therein to a refrigerant flow passage through which the refrigerant discharged from the compressor 10 flows to the heat-source-side heat exchanger 12*b* and the refrigerant in the inflow pipe 5*a* flows to the accumulator 19. Furthermore, the first refrigerant flow switching device 11*b* switches, in the heating operation, the flow passage to a flow passage through which refrigerant discharged from the compressor 10 does not flow and the refrigerant having flowed from the inflow pipe 5*a* flows through the heat-source-side heat exchanger 12*b* and flows to the accumulator 19. The second refrigerant flow switching device 11*c* is provided at the flow passage pipe 9. The second refrigerant flow switching device 11*c* switches, in the cooling operation a refrigerant flow passage therein to a refrigerant flow passage through which the flow of the refrigerant discharged from the compressor 10 is prevented by the heat-source-side backflow prevention device 15*a* and the refrigerant having flowed from the inflow pipe 5*a* flows to the accumulator 19. Furthermore, the second refrigerant flow switching device 11*c* inhibits, in the heating operation, refrigerant from flowing. It should be noted that flow passages in the refrigerant flow switching devices 11 are switched by power supplied by a controller 50 and a differential pressure between a high-pressure side and a low-pressure side in the refrigerant circuit. Therefore, in the air-conditioning apparatus 100 according to Embodiment 1, the second refrigerant flow switching device 11*c* and the discharge side of the compressor 10 are connected by pipes, whereby a high pressure of the refrigerant discharged from the compressor 10 is transferred to the second refrigerant flow switching device 11*c*.

In the air-conditioning apparatus 100 according to Embodiment 1, in the cooling only operation and the cooling main operation, refrigerant that has flowed from the inflow pipe 5*a* flows through three flow passages connected to the accumulator 19 and flows to the accumulator 19 via the respective refrigerant flow switching devices 11. In the cooling only operation and the cooling main operation, the refrigerant that flows from the inflow pipe 5*a* is low-temperature and low-pressure gas refrigerant or two-phase gas-liquid refrigerant. Therefore, when the refrigerant passes through the heat-source-side backflow prevention devices 15, a pressure loss increases. Thus, in the air-conditioning apparatus 100 according to Embodiment 1, in the cooling operation, low-temperature and low-pressure gas refrigerant or two-phase gas-liquid refrigerant is made to branch off to flow through the plurality of heat-source-side backflow prevention devices 15, whereby the air-conditioning apparatus 100 according to Embodiment 1 reduces the pressure loss caused by the heat-source-side backflow prevention devices 15 as a whole. Furthermore, in the air-conditioning apparatus 100 according to Embodiment 1, by increasing the number of flow passages that extend from the inflow pipe 5*a* to the accumulator 19, the total cross-sectional area of all the flow passages is increased, thereby reducing the pressure loss of the refrigerant.

The outdoor unit 1 includes a discharge temperature sensor 43, a discharge pressure sensor 40, and an outside-air temperature sensor 46. The discharge temperature sensor 43 detects the temperature of refrigerant discharged from the compressor 10 and outputs a discharge temperature detection signal. The discharge pressure sensor 40 detects the pressure of the refrigerant discharged by the compressor 10 and outputs a discharge pressure detection signal. The outside-air temperature sensor 46 detects, for example, an outside air temperature that is an ambient temperature of the outdoor unit 1, and outputs an outside-air temperature detection signal. In the outdoor unit 1, the outside-air temperature sensor 46 is provided at air-inflow part of the heat-source-side heat exchangers 12 into which air flows.

Furthermore, the outdoor unit 1 includes the controller 50 that controls various devices. The controller 50 is a device that controls each of the devices in the air-conditioning apparatus 100 and performs the entire air-conditioning apparatus 100. The controller 50 is, for example, an analog circuit, a digital circuit, a CPU, or a combination of two or more of these elements. The controller 50 controls various devices or various apparatuses, for example, based on data on a physical quantity detected by each of the above sensors and an instruction from an input device, such as a remote control unit, and causes the air-conditioning apparatus 100 to operate in each of operation modes which will be described later. Although FIG. 1 illustrates the case where the controller 50 is provided in the outdoor unit 1, it is not limiting. In the outdoor unit 1, the relay unit 3, and the indoor units 2, respective controllers 50 may be provided. Furthermore, in the indoor units 2, respective controllers 50 may be provided.

<Configuration of Relay Unit 3>

The relay unit 3 transfers heat supplied from the outdoor unit 1 that is a heat source unit to another unit. The relay unit 3 includes a gas-liquid separator 29, a first relay expansion device 30, and a second relay expansion device 27. Furthermore, the relay unit 3 includes a plurality of first opening and closing devices 23*a* to 23*d*, a plurality of second opening and closing devices 24*a* to 24*d*, a plurality of relay-side first backflow prevention devices 21*a* to 21*d*, and a plurality of relay-side second backflow prevention devices 22*a* to 22*d*.

In a cooling and heating mixed operation in which an air-cooling load is high, the gas-liquid separator 29 separates high-pressure two-phase gas-liquid refrigerant generated in the outdoor unit 1 into liquid refrigerant and gas refrigerant. The gas-liquid separator 29 causes the liquid refrigerant to flow into a pipe on a lower side of the figure to supply cooling energy to one or more of the indoor units 2, and also causes the gas refrigerant to flow into a pipe on an upper side of the figure to supply heating energy to another one or others of the indoor units 2. The gas-liquid separator 29 is provided at an inlet portion of the relay unit 3 in the flow of refrigerant.

The first relay expansion device 30 has functions of a pressure reducing valve and an on-off valve. The first relay expansion device 30 reduces the pressure of liquid refrigerant to a predetermined pressure and also opens and closes a flow passage for the liquid refrigerant. The opening degree of the first relay expansion device 30 can be adjusted, for example, continuously or by stages. As the first relay expansion device 30, for example, an electronic expansion valve is used. The first relay expansion device 30 is provided in at a pipe that allows the liquid refrigerant to flow out of the gas-liquid separator 29.

The second relay expansion device 27 has functions of a pressure reducing valve and an on-off valve. In the heating only operation, the second relay expansion device 27 opens a refrigerant flow passage therein to adjust the flow rate of the refrigerant. In the heating main operation, the second relay expansion device 27 adjusts the flow rate of liquid refrigerant that flows through a bypass, depending on an indoor-side load. The opening degree of the second relay expansion device 27 can be adjusted, for example, continuously or by stages. As the second relay expansion device 27, for example, an electronic expansion valve is used.

The first opening and closing devices 23*a* to 23*d* are provided for the indoor units 2*a* to 2*d*, respectively. The first opening and closing devices 23*a* to 23*d* open and close respective flow passages for high-temperature and high-pressure gas refrigerant that is supplied to the respective indoor units 2*a* to 2*d*. The first opening and closing devices 23*a* to 23*d* are, for example, solenoid valves or other valves. The first opening and closing devices 23*a* to 23*d* are each connected to a gas-side pipe of the gas-liquid separator 29. It should be noted that the first opening and closing devices 23*a* to 23*d* have only to open and close respective flow passages, and may each be an expansion device having a function of fully closing the flow passage.

The second opening and closing devices 24*a* to 24*d* are provided for the indoor units 2*a* to 2*d*, respectively. The second opening and closing devices 24*a* to 24*d* open and close respective flow passages for low-pressure and low-temperature gas refrigerant that has flowed out of the respective indoor units 2*a* to 2*d*. The second opening and closing devices 24*a* to 24*d* are, for example, solenoid valves or other valves. The second opening and closing devices 24*a* to 24*d* are connected to respective low-pressure pipes that extend to an outlet side of the relay unit 3. It should be noted that the second opening and closing devices 24*a* to 24*d* have only to open and close respective flow passages, and may each be an expansion device having a function of fully closing the flow passage.

The relay-side first backflow prevention devices 21*a* to 21*d* are provided for the indoor units 2*a* to 2*d*, respectively. Each of the relay-side first backflow prevention devices 21*a* to 21*d* allows high-pressure liquid refrigerant to flow into an associated one of the indoor units 2 when the associated indoor unit 2 is in the cooling operation. The relay-side first backflow prevention devices 21*a* to 21*d* are connected to a pipe on an outlet side of the first relay expansion device 30. In the cooling main operation mode and the heating main operation mode, each of the relay-side first backflow prevention devices 21*a* to 21*d* prevents intermediate-temperature and intermediate-pressure liquid refrigerant or two-phase gas-liquid refrigerant that flows out of the load-side expansion device 25 of an associated one of the indoor units 2 when the associated indoor unit 2 is in the heating operation, from flowing into a load-side expansion device 25 of another one or others of the indoor units 2 that are in the cooling operation. As the relay-side first backflow prevention devices 21*a* to 21*d*, for example, check valves are used. The relay-side first backflow prevention devices 21*a* to 21*d* have only to prevent the backflow of refrigerant, and, for example, an opening and closing device, or an expansion device having a function of fully closing the flow passage.

The relay-side second backflow prevention devices 22*a* to 22*d* are provided for the indoor units 2*a* to 2*d*, respectively. Each of the relay-side second backflow prevention devices 22*a* to 22*d* allows low-pressure gas refrigerant to flow into the relay-side second backflow prevention device from an associated one of the indoor units 2 when the associated indoor unit 2 is in the heating operation. The relay-side second backflow prevention devices 22*a* to 22*d* are connected to a pipe on the outlet side of the first relay expansion device 30. In the cooling main operation mode and the heating main operation mode, each of the relay-side second backflow prevention devices 22*a* to 22*d* inhibits intermediate-temperature and intermediate-pressure liquid or two-phase refrigerant that passes through the first relay expansion device 30, from flowing into a load-side expansion device 25 of an associated one of the indoor units 2 when the associated indoor unit 2 is in the cooling operation. As the relay-side second backflow prevention devices 22*a* to 22*d*, check valves are used. The relay-side second backflow prevention devices 22*a* to 22*d* have only to prevent the backflow of the refrigerant, and may be, for example, an opening and closing device or an expansion device having a function of fully closing the valve.

In the relay unit 3, a first relay-expansion-device inlet-side pressure sensor 33 is provided on an inlet side of the first relay expansion device 30. The first relay-expansion-device inlet-side pressure sensor 33 detects the pressure of high-pressure refrigerant. On the outlet side of the first relay expansion device 30, a first relay-expansion-device outlet-side pressure sensor 34 is provided. The first relay-expansion-device outlet-side pressure sensor 34 detects, in the cooling main operation mode, an intermediate pressure of liquid refrigerant on the outlet side of the first relay expansion device 30.

<Configuration of Indoor Units 2*a* to 2*d*>

The indoor units 2 receive heat transferred from the heat source unit and condition air of an air-conditioned space that is a load. The indoor units 2*a* to 2*d* are included in the refrigerant circuit. The indoor units 2*a* to 2*d* have, for example, the same configuration. The indoor unit 2*a* includes a load-side heat exchanger 26*a* and a load-side expansion device 25*a*; the indoor unit 2*b* includes a load-side heat exchanger 26*b* and a load-side expansion device 25*b*; the indoor unit 2*c* includes a load-side heat exchanger 26*c* and a load-side expansion device 25*c*; and The indoor unit 2*d* includes a load-side heat exchanger 26*d* and a load-side expansion device 25*d*. Each of the load-side heat exchangers 26*a* to 26*d* is connected, by associated branch pipes 8*a* and 8*b*, to the relay unit 3 connected with a refrigerant pipe 4. In each of the load-side heat exchangers 26*a* to 26*d*, heat exchange is performed between air supplied by a load-side fan (not illustrated) and refrigerant, and air for cooling or heating that is to be supplied to an indoor space is generated. The opening degrees of the load-side expansion devices 25*a* to 25*d* can be adjusted, for example, continuously or by steps. As the load-side expansion devices 25*a* to 25*d*, for example, electronic expansion valves are used. The load-side expansion devices 25*a* to 25*d* each have functions of a pressure reducing valve and an expansion valve. The load-side expansion devices 25*a* to 25*d* reduce the pressure of refrigerant to expand the refrigerant. In the flow of refrigerant in the cooling only operation mode, the load-side expansion devices 25*a* to 25*d* are provided upstream of the respective load-side heat exchangers 26*a* to 26*d*.

The indoor units 2*a* to 2*d* include a plurality of inlet-side temperature sensors 31*a* to 31*d* that detect the temperatures of refrigerant that flow into the load-side heat exchangers 26*a* to 26*d*, respectively. The indoor units 2*a* to 2*d* include a plurality of outlet-side temperature sensors 32*a* to 32*d* that detect the temperatures of refrigerant that has flowed out of the load-side heat exchangers 26*a* to 26*d*, respectively. The inlet-side temperature sensors 31*a* to 31*d* and the outlet-side temperature sensors 32*a* to 32*d* are, for example, thermistors or other devices. Each of the inlet-side temperature sensors 31*a* to 31*d* and the outlet-side temperature sensors 32*a* to 32*d* outputs a detection signal to the controller 50.

<Cooling Only Operation Mode>

Figure 2:
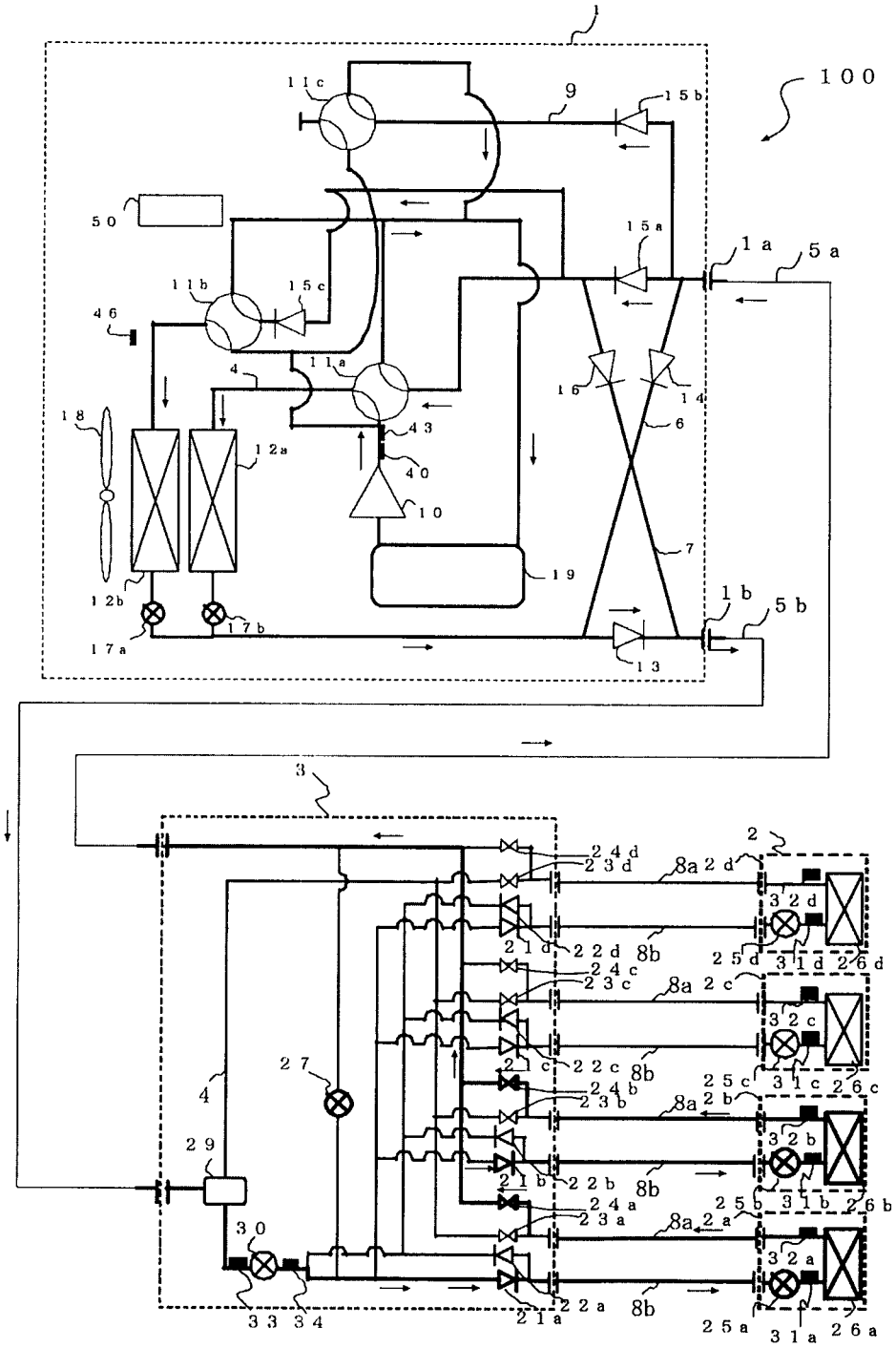
FIG. 2 is an explanatory view for the flow of refrigerant in a cooling only operation mode of the air-conditioning apparatus 100 according to Embodiment 1.

FIG. 2 illustrates the flow of refrigerant in the cooling only operation mode of the air-conditioning apparatus 100 according to Embodiment 1. In FIG. 2, the flow directions of the refrigerant are indicated by solid arrows. It is assumed that a cooling load is generated in the load-side heat exchangers 26*a* and 26*b*. In the cooling only operation mode, the controller 50, for example, causes the first refrigerant flow switching devices 11*a* and 11*b* included in the outdoor unit 1 to switch the respective flow passage to flow passages through which refrigerant discharged by the compressor 10 flows into the heat-source-side heat exchangers 12. Furthermore, the controller 50, for example, causes the second refrigerant flow switching device 11*c* to switch the flow passage to a flow passage through which refrigerant having flowed from the inflow pipe 5*a* into the outdoor unit 1 flow into the accumulator 19 through the flow passage pipe 9.

As illustrated in FIG. 2, low-temperature and low-pressure refrigerant is sucked into the compressor 10 and compressed by the compressor 10 to change into high-temperature and high-pressure gas refrigerant, and the high-temperature and high-pressure gas refrigerant is discharged from the compressor 10. The high-temperature and high-pressure gas refrigerant discharged from the compressor 10 flows into the heat-source-side heat exchangers 12*a* and 12*b* via the first refrigerant flow switching devices 11*a* and 11*b*. Then, the refrigerant that has flowed into the heat-source-side heat exchangers 12 changes into high-pressure liquid refrigerant while transferring heat to outdoor air. The high-pressure liquid refrigerant that has flowed out of the heat-source-side heat exchangers 12*a* and 12*b* passes through the heat-source-side expansion devices 17*a* and 17*b* and the heat-source-side backflow prevention device 13 and flows out of the outdoor unit 1. The refrigerant that has flowed out of the outdoor unit 1 flows into the relay unit 3 through the outflow pipe 5*b*.

The high-pressure liquid refrigerant that has flowed into the relay unit 3 passes through the gas-liquid separator 29 and the first relay expansion device 30, and most of the refrigerant passes through the relay-side first backflow prevention devices 21*a* and 21*b* and the branch pipes 8*b* and is expanded by the load-side expansion devices 25*a* and 25*b* to change into low-temperature and low-pressure two-phase gas-liquid refrigerant. Remaining part of the high-pressure refrigerant is expanded by the second relay expansion device 27 to change into low-temperature and low-pressure gas refrigerant or two-phase gas-liquid refrigerant. Then, the low-temperature and low-pressure gas refrigerant or two-phase gas-liquid refrigerant flows into the low-pressure pipe on the outlet side of the relay unit 3. At this time, the opening degree of the second relay expansion device 27 is controlled to cause the degree of subcooling of the refrigerant to be constant.

The two-phase gas-liquid refrigerant expanded by the load-side expansion devices 25*a* and 25*b* flows into the respective load-side heat exchangers 26*a* and 26*b* each of which operates as an evaporator, and receives heat from indoor air to cool the indoor air, thereby changing into low-temperature and low-pressure gas refrigerant. At this time, the opening degree of the load-side expansion device 25*a* is controlled to cause superheat that is the degree of superheat obtained as a difference between a temperature detected by the inlet-side temperature sensor 31*a* and a temperature detected by the outlet-side temperature sensor 32*a* to be constant. Similarly, the opening degree of the load-side expansion device 25*b* is controlled to cause superheat obtained as a difference between a temperature detected by the inlet-side temperature sensor 31*b* and a temperature detected by the outlet-side temperature sensor 32*b* to be constant.

The gas refrigerant that has flowed out of the load-side heat exchangers 26*a* and 26*b* passes through the respective branch pipes 8*a* and the respective second opening and closing devices 24*a* and 24*b* and flows out of the relay unit 3. The refrigerant that has flowed out of the relay unit 3 re-flows into the outdoor unit 1 though the inflow pipe 5*a*.

The refrigerant that has flowed from the inflow pipe 5*a* into the outdoor unit 1 branches off to pass through the heat-source-side backflow prevention devices 15*a* and 15*b*. The refrigerant that has passed through the heat-source-side backflow prevention device 15*b* passes through the second refrigerant flow switching device 11*c* and flows into the accumulator 19. Furthermore, the refrigerant that has passed through the heat-source-side backflow prevention device 15*a* further branches into refrigerant streams that are divided refrigerant. One of the refrigerant streams, i.e., the divided refrigerant, passes through the first refrigerant flow switching device 11*a* and flows into the accumulator 19, and the other passes through the heat-source-side backflow prevention device 15*c* and the first refrigerant flow switching device 11*b* and flows into the accumulator 19. The refrigerant that has passed through the accumulator 19 is re-sucked into the compressor 10.

In the case where no heating load is generated in the load-side heat exchanger 26*c* or 26*d*, refrigerant does not need to be made to flow therein, and the load-side expansion device 25*c* and 25*d* which are associated with the load-side heat exchangers 26*c* and 26*d*, respectively, are in a closed state. By contrast, in the case where a cooling load is generated in the load-side heat exchanger 26*c* or 26*d*, the load-side expansion device 25*c* or 25*d* is opened, and the refrigerant is circulated. At this time, the opening degree of the load-side expansion device 25*c* or the load-side expansion device 25*d* is controlled in the same manner as in the load-side expansion device 25*a* or 25*b*. Also, superheat obtained as a difference between a temperature detected by the inlet-side temperature sensor 31*c* or 31*d* and a temperature detected by the outlet-side temperature sensor 32*c* or 32*d* is caused to be constant.

<Cooling Main Operation Mode>

Figure 3:
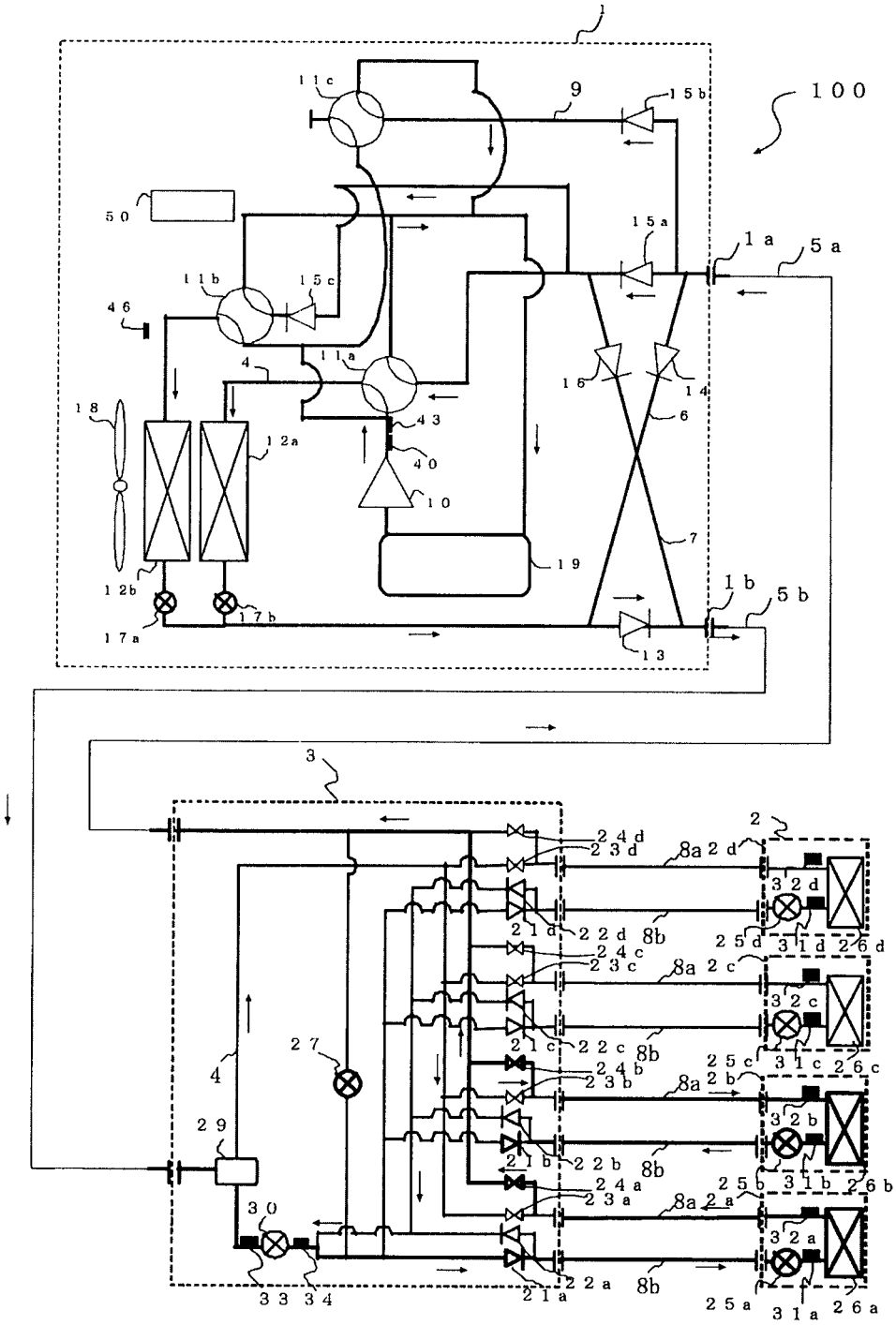
FIG. 3 is an explanatory view for the flow of refrigerant in a cooling main operation mode of the air-conditioning apparatus 100 according to Embodiment 1.

FIG. 3 illustrates the flow direction of refrigerant in the cooling main operation mode of the air-conditioning apparatus 100 according to Embodiment 1. In FIG. 3, flow directions of refrigerant are indicated by solid arrows. It is assumed that a cooling load is generated in the load-side heat exchanger 26*a* and a heating load is generated in the load-side heat exchanger 26*b*. In the cooling main operation mode, the controller 50, for example, causes the first refrigerant flow switching devices 11*a* and 11*b* included in the outdoor unit 1 to switch respective flow passages through which the refrigerant discharged from the compressor 10 flows into the heat-source-side heat exchangers 12. Furthermore, the controller 50, for example, causes the second refrigerant flow switching device 11*c* to switch the refrigerant flow passage to a refrigerant flow passage through which refrigerant having flowed from the inflow pipe 5*a* into the outdoor unit 1 passes through the flow passage pipe 9 and flows into the accumulator 19.

As illustrated in FIG. 3, low-temperature and low-pressure refrigerant is sucked into the compressor 10 and compressed by the compressor 10 to change into high-temperature and high-pressure gas refrigerant, and the high-temperature and high-pressure gas refrigerant is discharged from the compressor 10. The high-temperature and high-pressure gas refrigerant discharged from the compressor 10 flows into the heat-source-side heat exchangers 12*a* and 12*b* via the first refrigerant flow switching devices 11*a* and 11*b*. Then, the refrigerant that has flowed into the heat-source-side heat exchangers 12 transfers heat to outdoor air to change into high-pressure two-phase gas-liquid refrigerant. After flowing out of the heat-source-side heat exchangers 12*a* and 12*b*, the refrigerant passes through the heat-source-side expansion devices 17*a* and 17*b* and the heat-source-side backflow prevention device 13 and flows out of the outdoor unit 1. The refrigerant that has flowed out of the outdoor unit 1 flows into the relay unit 3 through the outflow pipe 5*b*.

The two-phase gas-liquid refrigerant that has flowed into the relay unit 3 is separated into high-pressure gas refrigerant and high-pressure liquid refrigerant by the gas-liquid separator 29. The high-pressure gas refrigerant passes through the first opening and closing device 23*b* and the branch pipe 8*a* and then flows into the load-side heat exchanger 26*b* that operates as a condenser. The high-pressure gas refrigerant transfers heat to indoor air to heat the indoor air, thereby changing into liquid refrigerant. At this time, the opening degree of the load-side expansion device 25*b* is controlled to cause subcooling that is the degree of subcooling obtained as a difference between a value obtained by converting a pressure detected by the first relay-expansion-device inlet-side pressure sensor 33 into a saturation temperature and a temperature detected by the inlet-side temperature sensor 31*b* to be constant. After flowing out of the load-side heat exchanger 26*b*, the liquid refrigerant is expanded by the load-side expansion device 25*b* and flows through the branch pipe 8*b* and the relay-side second backflow prevention device 22*b*.

Subsequently, intermediate-pressure liquid refrigerant into which the refrigerant is changed through expansion by the first relay expansion device 30 that causes the pressure of the refrigerant to reach an intermediate pressure, after being subjected to separation by the gas-liquid separator 29, joins the liquid refrigerant that has flowed through the relay-side second backflow prevention device 22*b*. At this time, the opening degree of the first relay expansion device 30 is controlled to cause a pressure difference between a pressure detected by the first relay-expansion-device inlet-side pressure sensor 33 and a pressure detected by the first relay-expansion-device outlet-side pressure sensor 34 to reach a predetermined pressure difference (for example, 0.3 MPa).

Most of the liquid refrigerant obtained by the above joining passes through the relay-side first backflow prevention device 21*a* and the branch pipe 8*b* and is expanded by the load-side expansion device 25*a* to change into low-temperature and low-pressure two-phase gas-liquid refrigerant. The remaining part of the liquid refrigerant is expanded by the second relay expansion device 27 to change into low-temperature and low-pressure gas refrigerant or two-phase gas-liquid refrigerant. At this time, the opening degree of the second relay expansion device 27 is controlled to cause subcooling of the refrigerant to be constant. Then, the low-temperature and low-pressure gas refrigerant or two-phase gas-liquid refrigerant flows into the low-pressure pipe on the outlet side of the relay unit 3.

On the other hand, the high-pressure liquid refrigerant that has been separated by the gas-liquid separator 29 passes through the relay-side first backflow prevention device 21*a* and flows into the indoor unit 2*a*. The two-phase gas-liquid refrigerant that has been obtained through expansion by the load-side expansion device 25*a* of the indoor unit 2*a* flows into the load-side heat exchanger 26*a* that operates as an evaporator, and receives heat from indoor air to cool the indoor air, thereby changing into low-temperature and low-pressure gas refrigerant. At this time, the opening degree of the load-side expansion device 25*a* is controlled to cause superheat obtained as a difference between a temperature detected by the inlet-side temperature sensor 31*a* and a temperature detected by the outlet-side temperature sensor 32*a* to be constant. After flowing out of the load-side heat exchanger 26*a*, the gas refrigerant passes through the branch pipe 8*a* and the second opening and closing device 24*a* and flows out of the relay unit 3. The refrigerant that has flowed out of the relay unit 3 re-flows into the outdoor unit 1 through the inflow pipe 5*a*.

The refrigerant that has flowed from the inflow pipe 5*a* into the outdoor unit 1 branches off to flow through the heat-source-side backflow prevention devices 15*a* and 15*b*. The refrigerant that has flowed through the heat-source-side backflow prevention device 15*b* passes through the second refrigerant flow switching device 11*c* and flows into the accumulator 19. Furthermore, the refrigerant that has flowed through the heat-source-side backflow prevention device 15*a* further branches into refrigerant streams that are divided refrigerant. One of the refrigerant streams, i.e., the divided refrigerant, passes through the first refrigerant flow switching device 11*a* and flows into the accumulator 19, and the other passes through the heat-source-side backflow prevention device 15*c* and the first refrigerant flow switching device 11*b* and flows into the accumulator 19. The refrigerant that has passed through the accumulator 19 is re-sucked into the compressor 10.

In the case where no heating load is generated in the load-side heat exchanger 26*c* or the load-side heat exchanger 26*d*, refrigerant does not need to be flow therein, and the load-side expansion devices 25*c* and 25*d* which are associated with the load-side heat exchangers 26*c* and 26*d*, respectively, are made to be in a closed state. By contrast, in the case where a cooling load is generated in the load-side heat exchanger 26*c* or 26*d*, the load-side expansion device 25*c* or 25*d* is opened to allow the refrigerant to circulate. At this time, the opening degree of the load-side expansion device 25*c* or the load-side expansion device 25*d* is controlled to cause superheat to be constant as in the load-side expansion device 25*a*. The superheat is a difference between a temperature detected by the inlet-side temperature sensor 31*c* or 31*d* and a temperature detected by the outlet-side temperature sensor 32*c* or 32*d*.

<Heating Only Operation Mode>

Figure 4:
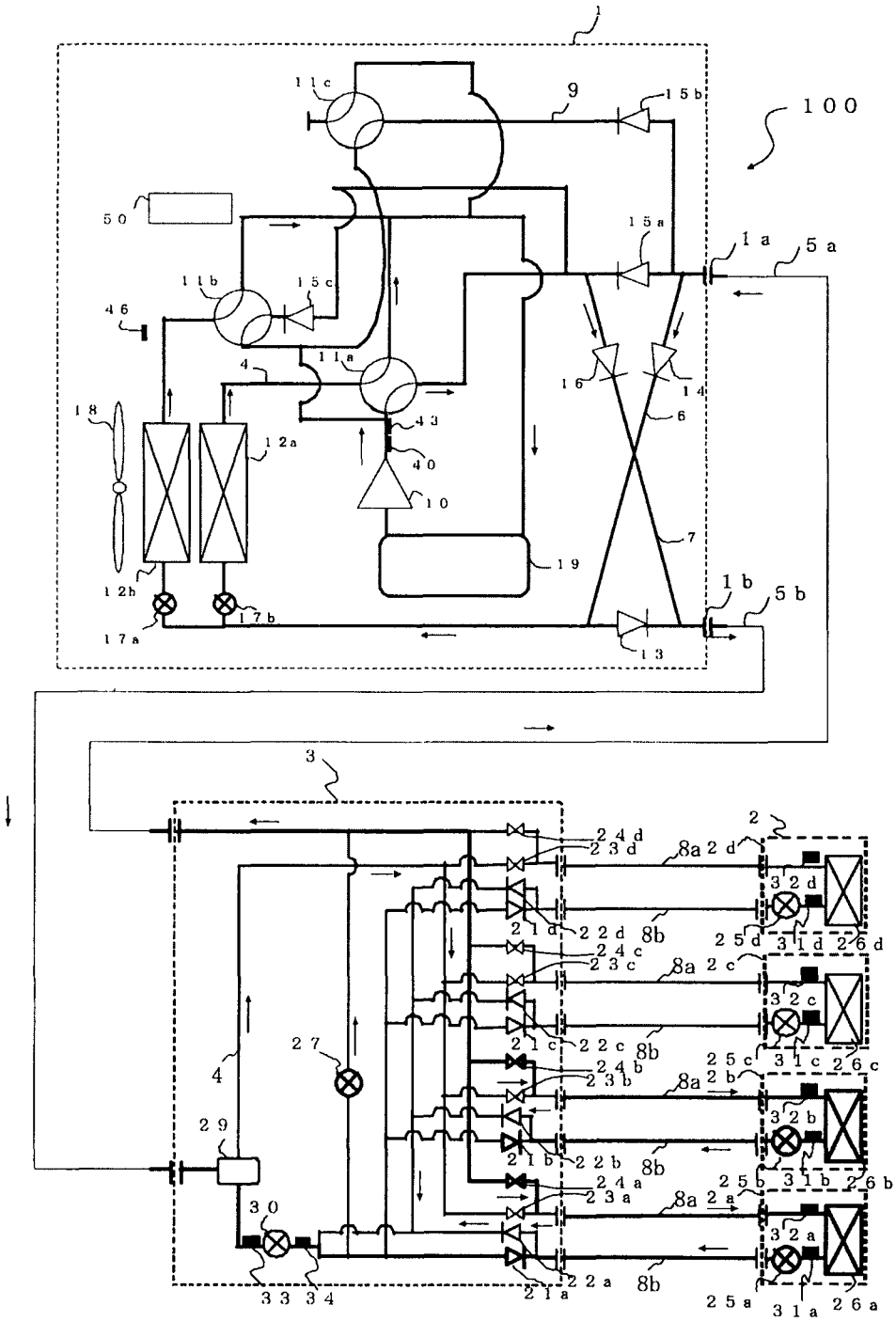
FIG. 4 is an explanatory view for the flow of refrigerant in a heating only operation mode of the air-conditioning apparatus 100 according to Embodiment 1.

FIG. 4 is an explanatory view for the flow of refrigerant in the heating only operation mode of the air-conditioning apparatus 100 according to Embodiment 1. In FIG. 4, flow directions of the refrigerant flows are indicated by solid arrows. It is assumed that a heating load is generated in the load-side heat exchanger 26*a* and the load-side heat exchanger 26*b*. In the heating only operation mode, the controller 50, for example, causes the first refrigerant flow switching devices 11*a* and 11*b* included in the outdoor unit 1 to switch respective flow passages to flow passages through which the refrigerant discharged by the compressor 10 directly passes through the outflow pipe 5*b* and flows into the relay unit 3. Furthermore, the controller 50 performs, for example, switching of the flow passage in the second refrigerant flow switching device 11*c* to inhibit refrigerant that has flowed from the inflow pipe 5*a* into the outdoor unit 1 from passing through the flow passage pipe 9.

As illustrated in FIG. 4, low-temperature and low-pressure refrigerant is sucked into the compressor 10 and compressed by the compressor 10 to change into high-temperature and high-pressure gas refrigerant, and the high-temperature and high-pressure gas refrigerant is discharged from the compressor 10. The refrigerant discharged from the compressor 10 passes through the first refrigerant flow switching device 11*a* and the heat-source-side backflow prevention device 16 and flows out of the outdoor unit 1. The refrigerant that has flowed out of the outdoor unit 1 passes through the outflow pipe 5*b* and flows into the relay unit 3.

The high-temperature and high-pressure gas refrigerant that has flowed into the relay unit 3 passes through the gas-liquid separator 29, the first opening and closing devices 23*a* and 23*b*, and the branch pipes 8*a* and then flows into the respective load-side heat exchangers 26*a* and 26*b* each of which operates as a condenser. The refrigerant that has flowed into the load-side heat exchangers 26*a* and 26*b* transfers heat to indoor air to heat the indoor air, thereby changing into liquid refrigerant. After flowing out of the load-side heat exchangers 26*a* and 26*b*, the liquid refrigerant is expanded by the respective load-side expansion devices 25*a* and 25*b*. Then, the expanded refrigerant passes through the branch pipes 8*b*, the relay-side second backflow prevention devices 22*a* and 22*b*, the second relay expansion device 27 controlled to be in an opened state, and the inflow pipe 5*a*, and re-flows into the outdoor unit 1. At this time, the opening degree of the load-side expansion device 25*a* is controlled to cause subcooling obtained as a difference between a value obtained by converting a pressure detected by the first relay-expansion-device inlet-side pressure sensor 33 into a saturation temperature and a temperature detected by the inlet-side temperature sensor 31*a* to be constant. Similarly, the opening degree of the load-side expansion device 25*b* is controlled to cause subcooling obtained as a difference between a value obtained by converting a pressure detected by the first relay-expansion-device inlet-side pressure sensor 33 into a saturation temperature and a temperature detected by the inlet-side temperature sensor 31*b* to be constant.

The refrigerant that has flowed from the inflow pipe 5*a* into the outdoor unit 1 passes through the heat-source-side backflow prevention device 13 and the heat-source-side expansion devices 17*a* and 17*b* and flows into the heat-source-side heat exchangers 12*a* and 12*b*. The refrigerant that has flowed into the heat-source-side heat exchangers 12*a* and 12*b* receives heat from outdoor air to change into low-temperature and low-pressure gas refrigerant, and the low-temperature and low-pressure gas refrigerant flows out of the heat-source-side heat exchangers 12*a* and 12*b*. The refrigerant that has flowed out of the heat-source-side heat exchangers 12*a* and 12*b* passes through the first refrigerant flow switching devices 11*a* and 11*b* and flows into the accumulator 19. The refrigerant that has passed through the accumulator 19 is re-sucked into the compressor 10.

In the case where no heating load is generated in the load-side heat exchanger 26*c* or the load-side heat exchanger 26*d*, refrigerant does not need to be made to flow therein, and the load-side expansion devices 25*c* and 25*d* which are associated with the load-side heat exchangers 26*c* and 26*d*, respectively, are in a closed state. By contrast, in the case where a heating load is generated in the load-side heat exchanger 26*c* or 26*d*, the load-side expansion device 25*c* or 25*d* is opened to allow the refrigerant to circulate. At this time, the opening degree of the load-side expansion device 25*c* or the load-side expansion device 25*d* is controlled to cause subcooling to be constant as in the above load-side expansion device 25*a* or 25*b*. The subcooling is obtained as a difference between a temperature detected by the inlet-side temperature sensor 31*c* or 31*d* and a temperature detected by the outlet-side temperature sensor 32*c* or 32*d*.

<Heating Main Operation Mode>

Figure 5:
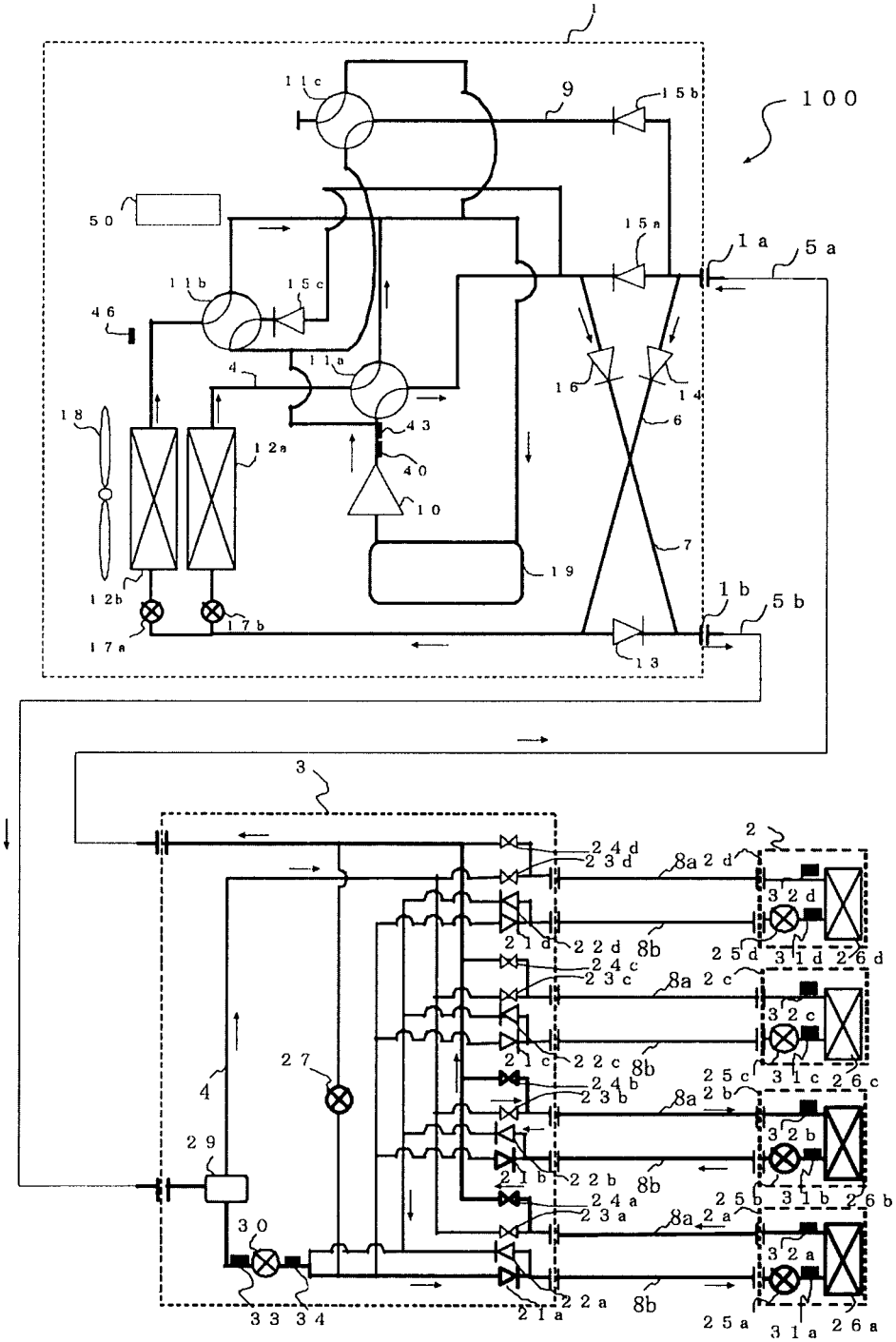
FIG. 5 is an explanatory view for the flow of refrigerant in a heating main operation mode of the air-conditioning apparatus 100 according to Embodiment 1.

FIG. 5 is an explanatory view for the flow of refrigerant in the heating main operation mode of the air-conditioning apparatus 100 according to Embodiment 1. In FIG. 5, flow directions of the refrigerant flows are indicated by solid arrows. It is assumed that a cooling load is generated in the load-side heat exchanger 26*a* and a heating load is generated in the load-side heat exchanger 26*b*. In the heating main operation mode, the controller 50, for example, causes the first refrigerant flow switching devices 11*a* and 11*b* included in the outdoor unit 1 to switch respective flow passages to flow passages through which refrigerant discharged by the compressor 10 directly passes through the outflow pipe 5*b* and flows into the relay unit 3. Furthermore, the controller 50 performs, for example, switching of the flow passage in the second refrigerant flow switching device 11*c* to inhibit refrigerant that has flowed form the inflow pipe 5*a* into the outdoor unit 1 from passing through the flow passage pipe 9.

As illustrated in FIG. 5, low-temperature and low-pressure refrigerant is sucked into the compressor 10 and compressed by the compressor 10 to change into high-temperature and high-pressure gas refrigerant, and the high-temperature and high-pressure gas refrigerant is discharged from the compressor 10. The refrigerant discharged from the compressor 10 passes through the first refrigerant flow switching device 11*a* and the heat-source-side backflow prevention device 16 and flows out of the outdoor unit 1. The refrigerant that has flowed out of the outdoor unit 1 flows into the relay unit 3 through the outflow pipe 5*b*.

The high-temperature and high-pressure gas refrigerant that has flowed into the relay unit 3 passes through the gas-liquid separator 29, the first opening and closing device 23*b*, and the branch pipe 8*a* and then flows into the load-side heat exchanger 26*b* that operates as a condenser. The refrigerant that has flowed into the load-side heat exchanger 26*b* transfers heat to indoor air to heat the indoor air, thereby changing into liquid refrigerant. After flowing out of the load-side heat exchanger 26*b*, the liquid refrigerant is expanded by the load-side expansion device 25*b* and passes through the branch pipe 8*b* and the relay-side second backflow prevention device 22*b*. Subsequently, most of the liquid refrigerant passes through the relay-side first backflow prevention device 21*a* and the branch pipe 8*b* and is then expanded by the load-side expansion device 25*a* to change into low-temperature and low-pressure two-phase gas-liquid refrigerant. Remaining part of the liquid refrigerant is expanded by the second relay expansion device 27 that is also provided in a bypass to change into intermediate-temperature and intermediate-pressure liquid or two-phase gas-liquid refrigerant. The liquid or two-phase gas-liquid refrigerant flows into a low-pressure pipe on the outlet side of the relay unit 3.

The two-phase gas-liquid refrigerant expanded by the load-side expansion device 25*a* flows into the load-side heat exchanger 26*a* that operates as an evaporator and receives heat from indoor air to cool the indoor air, thereby changing into low-temperature and intermediate-pressure two-phase gas-liquid refrigerant. After flowing out of the load-side heat exchanger 26*a*, the two-phase gas-liquid refrigerant passes through the branch pipe 8*a* and the second opening and closing device 24*a* and flows out of the relay unit 3. The refrigerant that has flowed out of the relay unit 3 re-flows into the outdoor unit 1 through the inflow pipe 5*a*.

The refrigerant that has flowed from the inflow pipe 5*a* into the outdoor unit 1 passes through the heat-source-side backflow prevention device 13 and the heat-source-side expansion devices 17*a* and 17*b* and flows into the heat-source-side heat exchangers 12*a* and 12*b*. The refrigerant that has flowed into the heat-source-side heat exchangers 12*a* and 12*b* receives heat from outdoor air to change into low-temperature and low-pressure gas refrigerant, and the low-temperature and low-pressure gas refrigerant flows out of the heat-source-side heat exchangers 12*a* and 12*b*. The refrigerant that has flowed out of the heat-source-side heat exchangers 12*a* and 12*b* passes through the first refrigerant flow switching devices 11*a* and 11*b* and flows into the accumulator 19. The refrigerant that has passed through the accumulator 19 is re-sucked into the compressor 10.

At this time, the opening degree of the load-side expansion device 25*b* is controlled to cause subcooling obtained as a difference between a value obtained by converting a pressure detected by the first relay-expansion-device inlet-side pressure sensor 33 into a saturation temperature and a temperature detected by the inlet-side temperature sensor 31*b* to be constant. On the other hand, the opening degree of the load-side expansion device 25*a* is controlled to cause superheat obtained as a difference between a temperature detected by the inlet-side temperature sensor 31*a* and a temperature detected by the outlet-side temperature sensor 32*a* to be constant.

The opening degree of the second relay expansion device 27 is controlled to cause subcooling of the refrigerant to be constant. For example, the opening degree of the second relay expansion device 27 is controlled to cause a pressure difference between a pressure detected by the first relay-expansion-device inlet-side pressure sensor 33 and a pressure detected by the first relay-expansion-device outlet-side pressure sensor 34 to reach a predetermined pressure difference (for example, 0.3 MPa).

In the case where no heating load is generated in the load-side heat exchanger 26*c* or 26*d*, refrigerant does not need to be made to flow therein, and the load-side expansion devices 25*c* and 25*d* which are associated with the load-side heat exchangers 26*c* and 26*d*, respectively, are in a closed state. By contrast, in the case where a heating load is generated in the load-side heat exchanger 26*c* or 26*d*, the load-side expansion device 25*c* or 25*d* is opened to allow the refrigerant to circulate.

As described above, the air-conditioning apparatus 100 according to Embodiment 1 includes the flow passage pipe 9, the heat-source-side backflow prevention device 15*b*, which is a flow rate pipe backflow prevention device, and the second refrigerant flow switching device 11*c*. During the cooling operation, for example, in the cooling only operation mode and the cooling main operation mode, in the air-conditioning apparatus 100, refrigerant that has flowed from the inflow pipe 5*a* into the outdoor unit 1 is made to branch off to flow into the accumulator 19 through the flow passage pipe 9. Thus, in the air-conditioning apparatus 100 according to Embodiment 1, the amount of low-temperature and low-pressure gas refrigerant or two-phase gas-liquid refrigerant that passes through the heat-source-side backflow prevention device 15*a* can be reduced, and the pressure loss of the refrigerant can be reduced. Furthermore, in the air-conditioning apparatus 100 according to Embodiment 1, the number of flow passages through which the low-temperature and low-pressure gas refrigerant or two-phase gas-liquid refrigerant that has flowed from the inflow pipe 5*a* into the outdoor unit 1 passes is increased, and as a result the pressure loss of the refrigerant can thus be reduced.

Embodiment 2

Figure 6:
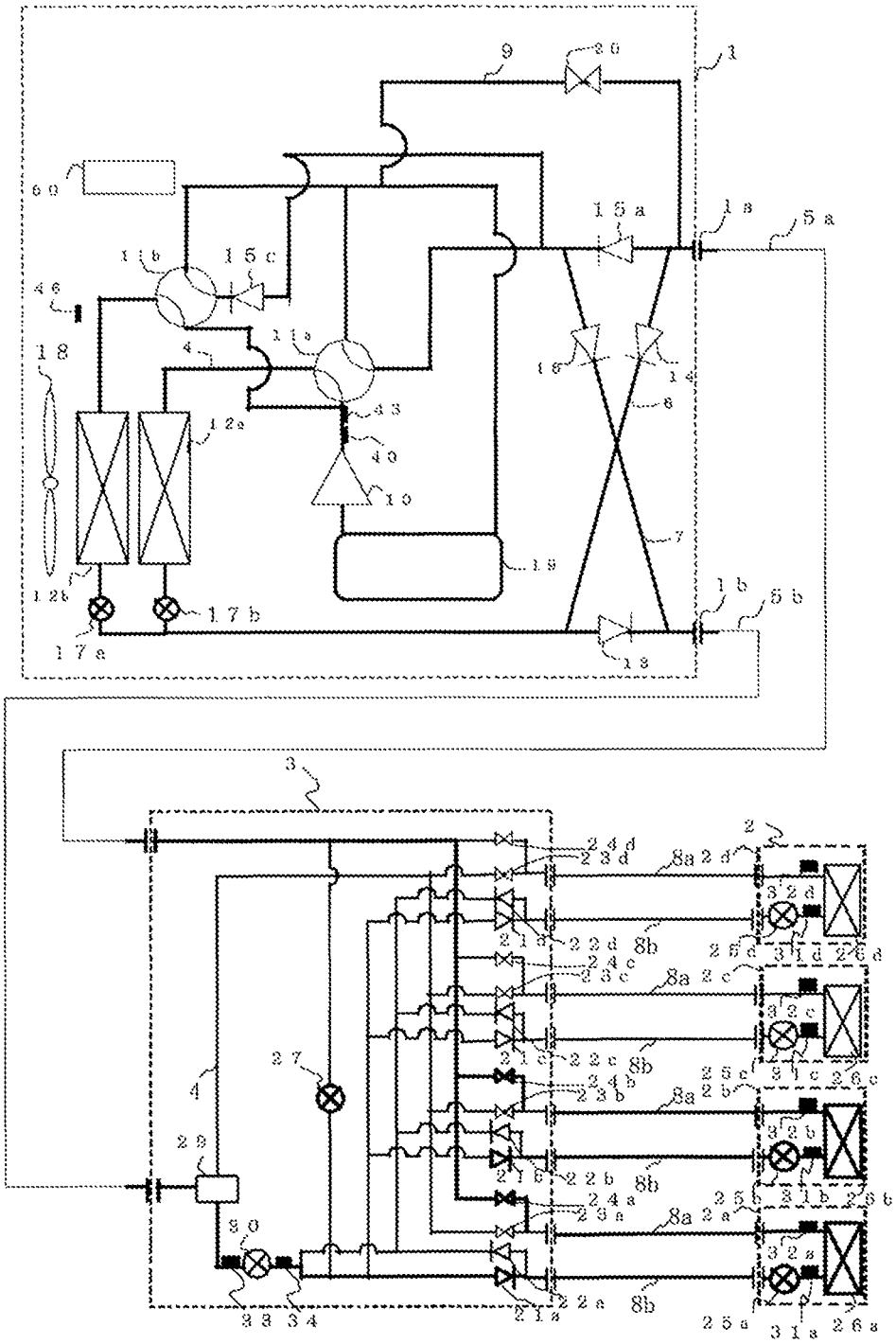
FIG. 6 illustrates a configuration of the air-conditioning apparatus 100 according to Embodiment 2.

FIG. 6 illustrates a configuration of the air-conditioning apparatus 100 according to Embodiment 2. In FIG. 6, for example, devices, etc., that are denoted by the same reference signs as those in FIG. 1 or other figures fulfill and perform functions and operations similar to those described regarding Embodiment 1.

As illustrated in FIG. 6, in the air-conditioning apparatus 100 according to Embodiment 2, the outdoor unit 1 includes an opening and closing switching valve 20 that is an opening and closing device. When being opened, the opening and closing switching valve 20 allows the refrigerant to flow through the flow passage pipe 9. On the other hand, when being closed, the opening and closing switching valve 20 does not allow the refrigerant to flow through the flow passage pipe 9. The controller 50 performs a control to open/close the opening and closing switching valve 20.

In the air-conditioning apparatus 100 according to Embodiment 2, the opening and closing switching valve 20 is provided at the flow passage pipe 9 in place of the second refrigerant flow switching device 11*c* and the heat-source-side backflow prevention device 15*b* which is a flow rate pipe backflow prevention device. During the cooling operation, for example, in the cooling only operation mode and the cooling main operation mode, the controller 50 performs a control to open the opening and closing switching valve 20, thereby allowing low-temperature and low-pressure gas refrigerant or two-phase gas-liquid refrigerant that has flowed from the inflow pipe 5*a* into the outdoor unit 1 to flow through the flow passage pipe 9. Therefore, as in Embodiment 1, in the air-conditioning apparatus 100 according to Embodiment 2, the amount of refrigerant that passes through the heat-source-side backflow prevention device 15*a* can be reduced, and the pressure loss of the refrigerant can be reduced. Furthermore, the number of flow passages through which the low-temperature and low-pressure gas refrigerant or two-phase gas-liquid refrigerant that has flowed from the inflow pipe 5*a* into the outdoor unit 1 passes is increased, and as a result the pressure loss of the refrigerant can be reduced.

Embodiment 3

Although each of the above air-conditioning apparatuses 100 according to Embodiments 1 and 2 is an air-conditioning apparatus in which refrigerant is made to flow through an indoor unit 2 to cool or heat an air-conditioned space, each air-conditioning apparatus 100 is not limited to such an air-conditioning apparatus. For example, the air-conditioning apparatus 100 can be used, for example, as an air-conditioning apparatus or chiller system that includes a heat medium circuit through which a heat medium, such as water, circulates and that heats or cools the heat medium by using heat supplied from the outdoor unit 1 and causes heat exchange to be performed between the heated or cooled heat medium and air of an air-conditioned space to condition the air.

Furthermore, although it is described above that in each of the above air-conditioning apparatuses 100 according to Embodiments 1 and 2, two heat-source-side heat exchangers 12*a* and 12*b* are provided in parallel, it is not limiting. The number of heat-source-side heat exchangers 12 may be one. In this case, the first refrigerant flow switching device 11*b* and the heat-source-side backflow prevention device 15*c* need not be provided. Furthermore, the number of the heat-source-side heat exchangers 12 may be three or more.

Additionally, although regarding Embodiments 1 and 2, the air-conditioning apparatus 100 is described as an air-conditioning apparatus that is capable of performing the simultaneous cooling and heating operation in which the cooling main operation and the heating main operation can be performed, the air-conditioning apparatus 100 is not limited to such an air-conditioning apparatus. The air-conditioning apparatus 100 can be used as an air-conditioning apparatus 100 including the outdoor unit 1 in which a pipe through which refrigerant flows out of the outdoor unit 1 is used as a dedicated outflow pipe and a pipe through which refrigerant flows into the outdoor unit 1 is used as a dedicated inflow pipe; that is, the pipe used as the outflow pipe and the pipe used as the inflow pipe are not changed.

Furthermore, in Embodiments 1 and 2 described above, for example, a combination of a plurality of check valves may be provided to enable, during the cooling operation, refrigerant to pass through the flow passage pipe 9, for example, because of a differential pressure. In this case, the controller 50 need not perform control.

In the above air-conditioning apparatus 100 according to Embodiment 1, refrigerant that has passed through the heat-source-side backflow prevention device 15*a* is made to further branch off to flow toward the first refrigerant flow switching device 11*a* and toward the heat-source-side backflow prevention device 15*c* and the first refrigerant flow switching device 11*b*. The amount of refrigerant that passes through the heat-source-side backflow prevention device 15*c* is smaller than the amount of refrigerant that passes through the heat-source-side backflow prevention device 15*a*, whereby as the heat-source-side backflow prevention device 15*c*, a check valve smaller than the heat-source-side backflow prevention device 15*a* can be used. However, the air-conditioning apparatus 100 is not limited to such an air-conditioning apparatus. In the air-conditioning apparatus 100, for example, the heat-source-side backflow prevention devices 15*a*, 15*b*, and 15*c* may be connected in parallel. Thus, refrigerant that has flowed from the inflow pipe 5*a* into the outdoor unit 1 can be made to branch into three refrigerant streams.

The invention claimed is:

1. An outdoor unit comprising:

a compressor configured to suck refrigerant, compress the sucked refrigerant, and discharge the compressed refrigerant;

first and second refrigerant flow switching four-way valves configured to switch a flow passage for the refrigerant between a flow passage for a cooling operation and a flow passage for a heating operation;

a plurality of heat-source-side heat exchangers, each configured to cause heat exchange to be performed between the refrigerant and external fluid;

a plurality of heat-source-side backflow prevention check valves and a plurality of connection pipes that are included in a flow passage for the refrigerant in which an outlet from which the refrigerant flows out to an outside region and an inlet into which the refrigerant flows from the outside region are unchanged regardless of which of the cooling operation and the heating operation is performed;

first and second flow-passage-pipe backflow prevention check valves, respectively provided on first and second flow passage pipes, configured to prevent during the cooling operation backflow of the refrigerant to the inlet from being caused by switching of the first and second refrigerant flow switching four-way valves;

a third flow passage pipe through which part of the refrigerant having flowed from the inlet passes during the cooling operation;

a third refrigerant flow switching four-way valve provided at the third flow passage pipe and configured to control passage of the refrigerant;

a third flow-passage-pipe backflow prevention check valve provided at the third flow passage pipe and configured to prevent during the cooling operation backflow of the refrigerant to the inlet from being caused by switching by the second of the third refrigerant flow switching four-way valve;

an accumulator, provided on a suction side of the compressor, that stores surplus refrigerant and supplies refrigerant to the compressor; and a controller configured to control the switching of the first, second, and third refrigerant flow switching four-way valves, wherein:

during the cooling operation, refrigerant entering the outdoor unit through the inlet is divided into a first branch to the first and second flow passage pipes and into a second branch to the third flow passage pipe, during the cooling operation, the first and second switching four-way valves pass refrigerant divided into the first branch to the accumulator and further pass refrigerant flowing out of a discharge side of the compressor to the plurality of heat exchangers, and during the cooling operation, the third switching four-way valve passes refrigerant divided into the second branch to the accumulator.

2. The outdoor unit of claim 1, wherein in the third refrigerant flow switching four-way valve, switching between flow passages is performed by power supplied by the controller and a differential pressure in a refrigerant circuit.

3. An air-conditioning apparatus comprising:

the outdoor unit of claim 1; and an indoor unit configured to receive heat transferred from the outdoor unit and condition air in an air-conditioned space.

4. An air-conditioning apparatus comprising:

the outdoor unit of claim 2; and an indoor unit configured to receive heat transferred from the outdoor unit and condition air in an air-conditioned space.

* * * * *